US007228764B1

(12) United States Patent
Macor

(10) Patent No.: US 7,228,764 B1
(45) Date of Patent: Jun. 12, 2007

(54) MAXIMUM ENGAGEMENT WRENCH

(75) Inventor: Richard J. Macor, Hunterdon County, NJ (US)

(73) Assignee: Proprietary Technologies, Inc., Hunterdon County, NJ (US)

( * ) Notice: Subject to any disclaimer, the term of this patent is extended or adjusted under 35 U.S.C. 154(b) by 0 days.

(21) Appl. No.: 11/322,310

(22) Filed: Dec. 31, 2005

(51) Int. Cl.
*B25B 13/06* (2006.01)

(52) U.S. Cl. ..... 81/121.1; 81/124.3; 81/124.6

(58) Field of Classification Search ..... 81/119, 81/121.1, 186, 441, 124.3, 124.6; D8/28, D8/29
See application file for complete search history.

(56) References Cited

U.S. PATENT DOCUMENTS 2,777,353 A * 1/1957 Willis ..... 81/121.1
4,671,141 A * 6/1987 Hanson ..... 81/441
D385,166 S * 10/1997 Mundon ..... D8/29
5,983,758 A * 11/1999 Tanner ..... 81/121.1
6,997,085 B2 * 2/2006 Yamamoto ..... 81/121.1
7,107,879 B1 * 9/2006 Cheng ..... 81/121.1

* cited by examiner

*Primary Examiner*—Hadi Shakeri

(57) ABSTRACT

A tool device is described which comprises an orifice which has at least one engagement end formed to control the rotation of a work piece. The tool device has a peripheral terminal end at the engagement end. The orifice is defined by an inner wall of alternating recessed regions and engagement regions arranged about an imaginary central axis. The recessed regions and engagement regions extend longitudinally and substantially parallel to the imaginary central axis. And, at least a part of each engagement region extends farther towards the peripheral terminal end of the tool device than at least a part of each recessed region.

12 Claims, 4 Drawing Sheets

FIG. 5
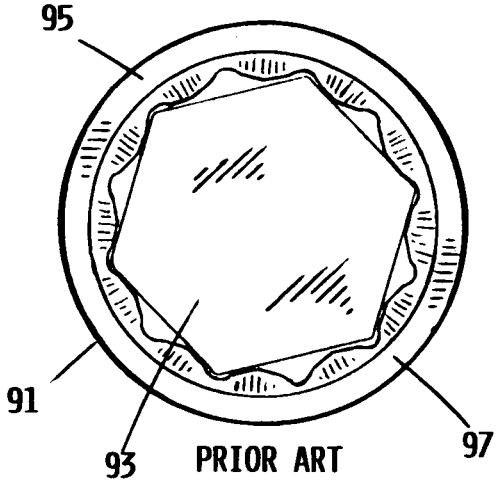
FIG. 7
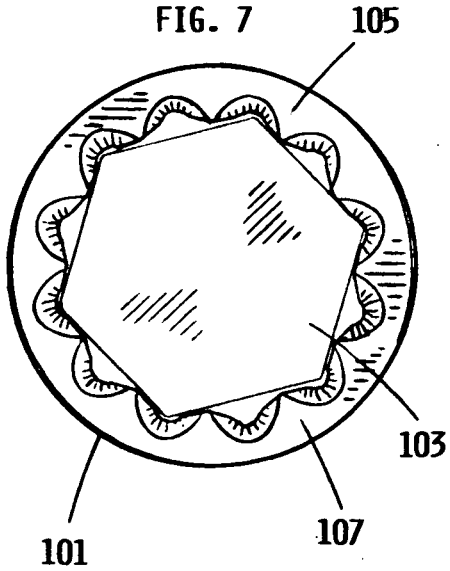
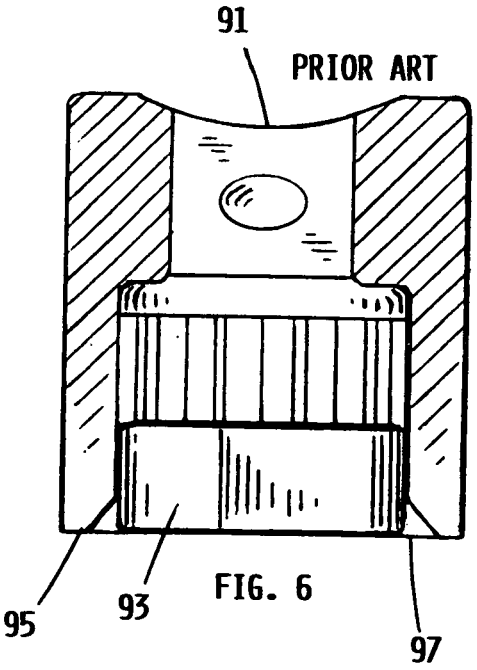
FIG. 6
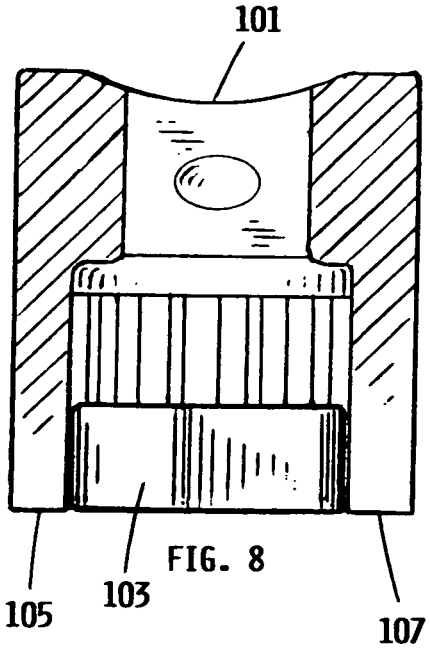
FIG. 8

FIG. 9
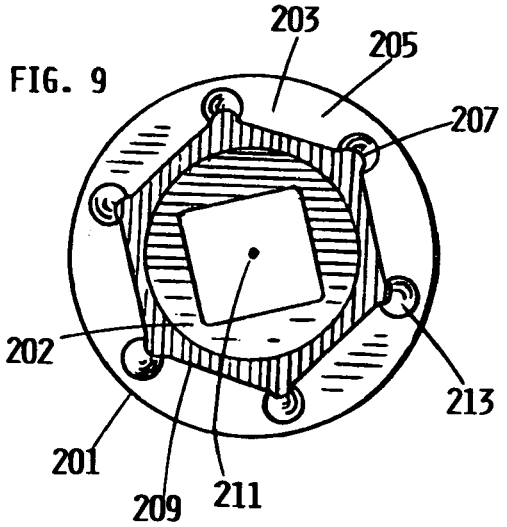
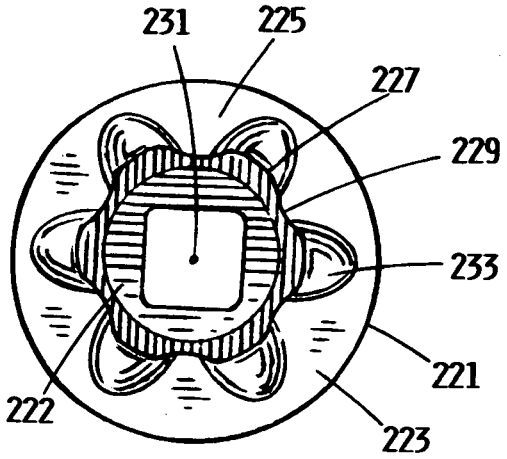
FIG. 10
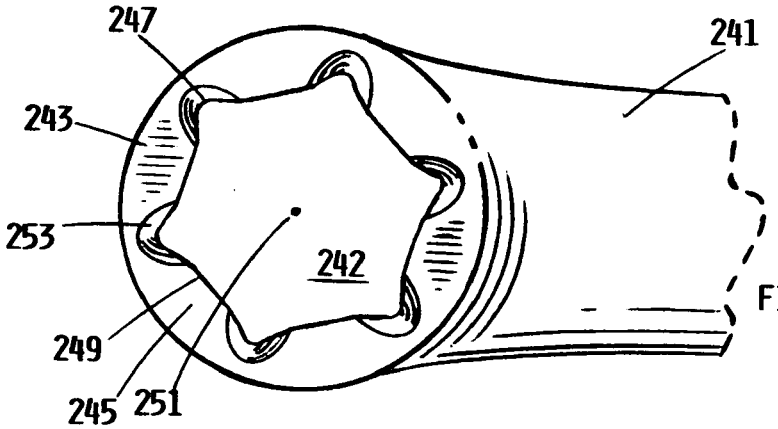
FIG. 11
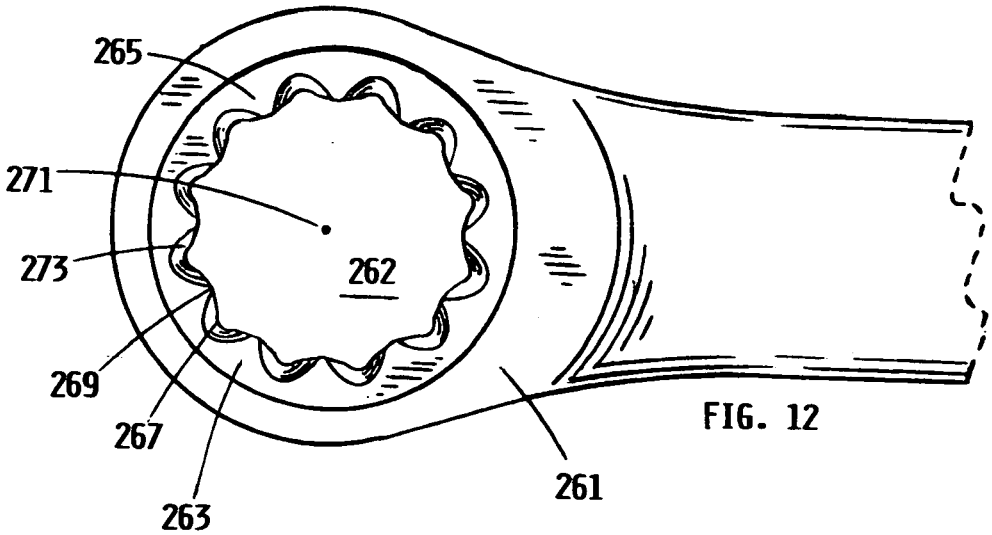
FIG. 12

MAXIMUM ENGAGEMENT WRENCH

FIELD OF THE INVENTION

The present invention relates to hand tool devices, particularly hand operated wrenches, and more particularly wrench sockets, box type wrenches, combination wrenches, flare nut wrenches, flex head wrenches, ratcheting type wrenches and the like.

BACKGROUND OF THE INVENTION

Wrenches have been around for hundreds of years and they generally have openings or orifices formed to control the rotation of a work piece such as a fastener, nut, bolt, etc. As long as there have been wrenches, there have been wrench engagement failures, whereas, a wrench slips or fails to properly grip a work piece under torque. Wrench engagement failures often result in damage to the work piece, damage to the wrench, and sometimes user injury. Over the past couple decades, lateral engagement designs have been greatly improved, providing "off corner" loading and "force distribution" to minimize lateral engagement failures. Nonetheless, the improved lateral engagement designs only affect improvements in lateral (horizontal) engagement, not longitudinal (vertical) engagement. In fact, applicant believes that the newer lateral engagement designs actually reduce longitudinal engagement contact, and in some instances, actually fail to engage with as much as 35% of the vertical surfaces of a work piece such as a fastener, nut, bolt etc. To make matters worse, the loss of engagement occurs at the base of the work piece, believed by applicant to be the most critical area of engagement necessary to reduce wrench engagement failures and maximize torque capacity.

In addition, wrench engagement failures often occur when a wrench becomes disoriented or tilted on a work piece under torque. These types of engagement failures are referred to herein as "tilt-off" events. More specifically, applicant defines a "tilt-off" event as an engagement failure that occurs when a user is turning a work piece such as a fastener (either tightening or loosening) and the wrench becomes slightly tilted on the fastener. When this occurs, the forces involved tend to push the wrench away from and off the fastener often damaging the fastener and/or wrench, and possibly injuring the user. Engagement failures also occur when a wrench is turning a fastener that is rusted, eroded or otherwise tapered from its base. Applicant defines a "taper-off" event as an engagement failure that occurs when a user is turning a work piece such as a fastener (either tightening or loosening) which is slightly rusted, eroded or otherwise tapered from its base. When this occurs, the forces involved tend to push the wrench away from and off the fastener often damaging the fastener and/or wrench, and possibly injuring the user. Applicant believes that the "tilt-off" and "taper-off" events defined herein occur easily and frequently because it is difficult for a user to maintain a continuous, properly seated relationship between a wrench and fastener when both are being forcibly turned, and, it's very common to encounter a fastener which is slightly rusted, eroded, or tapered from its base.

Therefore, applicant believes there is a significant need to improve upon prior art wrench opening designs to overcome the deficiencies identified above.

SUMMARY OF THE INVENTION

In one embodiment, the present invention is a tool device which comprises an orifice that has at least one engagement end formed to control the rotation of a work piece. The tool device has a peripheral terminal end at the engagement end. The orifice is defined by an inner wall of alternating recessed regions and engagement regions arranged about an imaginary central axis. The recessed regions and engagement regions extend longitudinally and substantially parallel to the imaginary central axis. At least a part of each engagement region extends farther towards the peripheral terminal end of the tool device than at least a part of each recessed region.

With regards to the present invention above, applicant considers the following objectives.

It is an important objective of the present invention that the orifice of the tool device provides a substantial initial vertical engagement with a work piece to reduce the potential of engagement failures.

And, it is another important objective of the present invention that the orifice of the tool device provides a substantial initial vertical engagement with a work piece to reduce the potential of a "tilt-off" event.

And, it is another important objective of the present invention that the orifice of the tool device provides a substantial initial vertical engagement with a work piece to reduce the potential of a "taper-off" event.

And, it is another important objective of the present invention that the tool device has sufficient structural strength to reduce the potential of engagement failures resulting from tool wear and/or breakage.

And, it is yet another objective of the present invention that the tool device be cost-efficient to manufacture and commercially viable.

DETAILED DESCRIPTION OF THE DRAWINGS

The various drawings provided herein are for the purpose of illustrating possible embodiments of the present invention and not for the purpose of limiting same. Therefore, the drawings herein represent only a few of the many possible embodiments, variations and/or applications of the present invention.

Figure 1:
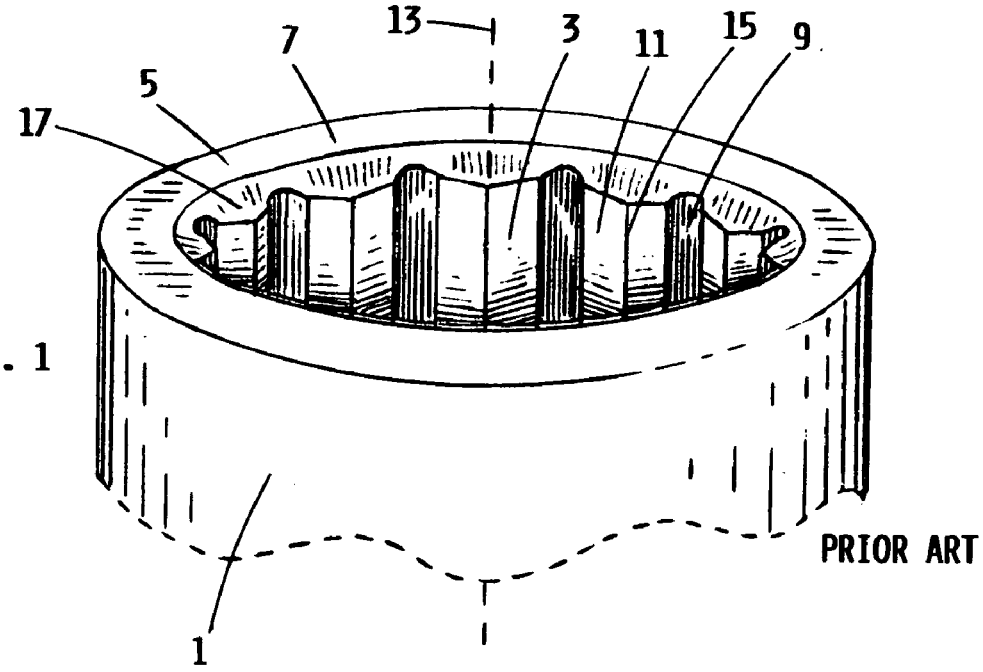
FIG. 1 shows a perspective, cut view of a prior art tool device.

FIG. 1 shows a perspective, cut view of a prior art tool device 1 which has an orifice 3 which has at least one engagement end 5 formed to control the rotation of a work piece. Tool device 1 has a peripheral terminal end 7 which is the terminal or distal end of tool device 1 at engagement end 5. Orifice 3 is further defined by an inner wall of alternating recessed regions and engagement regions arranged about an imaginary central axis 13. Recessed region 9 is representative of the recessed regions; and, engagement region 11 is representative of the engagement regions. The recessed regions and engagement regions extend longitudinally and substantially parallel to imaginary central axis 13 as shown. Importantly, tool device 1 is beveled completely around and into orifice 3 with a beveled surface 17 as shown, to facilitate initial alignment of orifice 3 with a work piece such as a nut, bolt, etc (not shown.) Unfortunately, this beveling reduces the terminal length of the engagement regions, particularly at the engagement region parts such as that represented by engagement region part 15 of engagement region 11. This prior art wrench configuration prohibits maximum longitudinal engagement with a work piece. Worse yet, the loss of engagement occurs at the base of the work piece, believed by applicant to be the most critical area of engagement necessary to reduce wrench engagement failures and maximize torque capacity. As a matter of clarification, a "recessed region" shall be defined herein as a region of longitudinal surfaces generally positioned farthest away from the imaginary central axis of the orifice and between longitudinal engagement regions. A longitudinal "engaging region" shall be defined herein as a region of longitudinal surfaces generally positioned between recessed regions and structured to actually engage with a work piece from initial contact and throughout the entire torque process. Embodiments of the present invention tool devices may have a predetermined quantity of recessed regions with the predetermined quantity determined by the structural features of the intended work piece. Nonetheless, a quantity of recessed regions divisible by six using whole numbers is contemplated.

Figure 2:
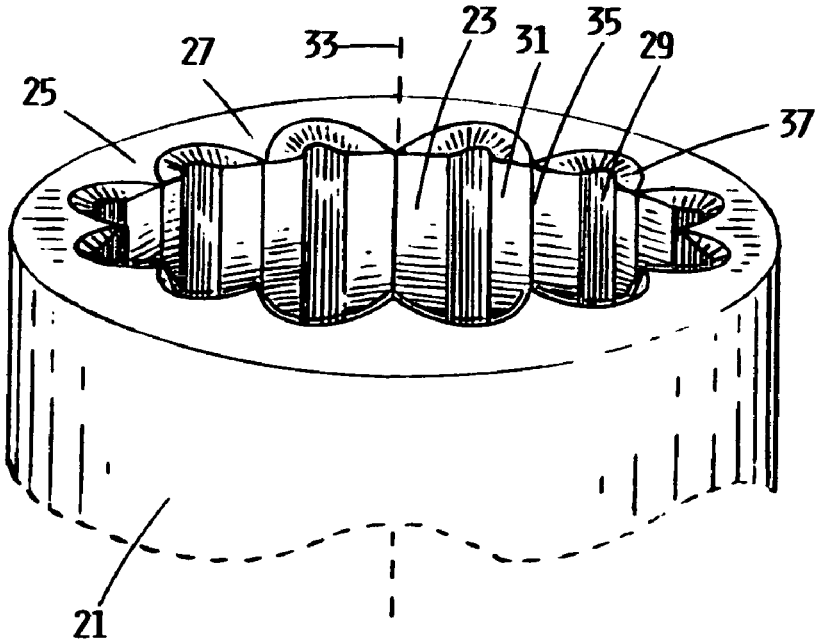
FIG. 2 shows a perspective, cut view of a present invention tool device; and, FIG. 3 shows a front elevation, cross-sectional cut view of another prior art tool device; and, FIG. 4 shows a front elevation, cross-sectional cut view of another present invention tool device; and, FIG. 5 shows a top plan view of another prior art tool device and work piece; and, FIG. 6 shows a front elevation, cross-sectional view of the tool device and work piece shown in FIG. 5; and, FIG. 7 shows a top plan view of another present invention tool device and work piece; and, FIG. 8 shows a front elevation, cross-sectional view of the tool device and work piece shown in FIG. 7; and, FIG. 9 shows a top plan view of another present invention tool device with six recessed regions; and, FIG. 10 shows a top plan view of another present invention tool device with six recessed regions; and, FIG. 11 shows a top plan view of a present invention tool device box wrench with six recessed regions; and, FIG. 12 shows a top plan view of another present invention tool device box wrench with a ratcheting mechanism and twelve recessed regions.

FIG. 2 shows a perspective, cut view of a present invention tool device 21 which has an orifice 23 which has at least one engagement end 25 formed to control the rotation of a work piece. Tool device 21 has a peripheral terminal end 27 which is the terminal or distal end of the tool device at engagement end 25. Orifice 23 is further defined by an inner wall of alternating recessed regions and engagement regions arranged about an imaginary central axis 33. Recessed region 29 is representative of the recessed regions; and, engagement region 31 is representative of the engagement regions of tool device 21. The recessed regions and engagement regions extend longitudinally and substantially parallel to imaginary central axis 33 as shown. Importantly, at least a part of each engagement region (such as engagement part 35 of engagement region 31) extends farther towards the peripheral terminal end 27 of tool device 21 than at least a part of each recessed region such as recessed region 29. This is better seen in the front elevation, cross-sectional cut view of another present invention tool device shown in FIG. 4. The present invention shown here in FIG. 2 increases the amount of longitudinal engagement to a work piece, particularly at the base of a work piece believed by applicant to be the most critical area of engagement necessary to reduce wrench engagement failures and maximize torque capacity.

Figure 3:
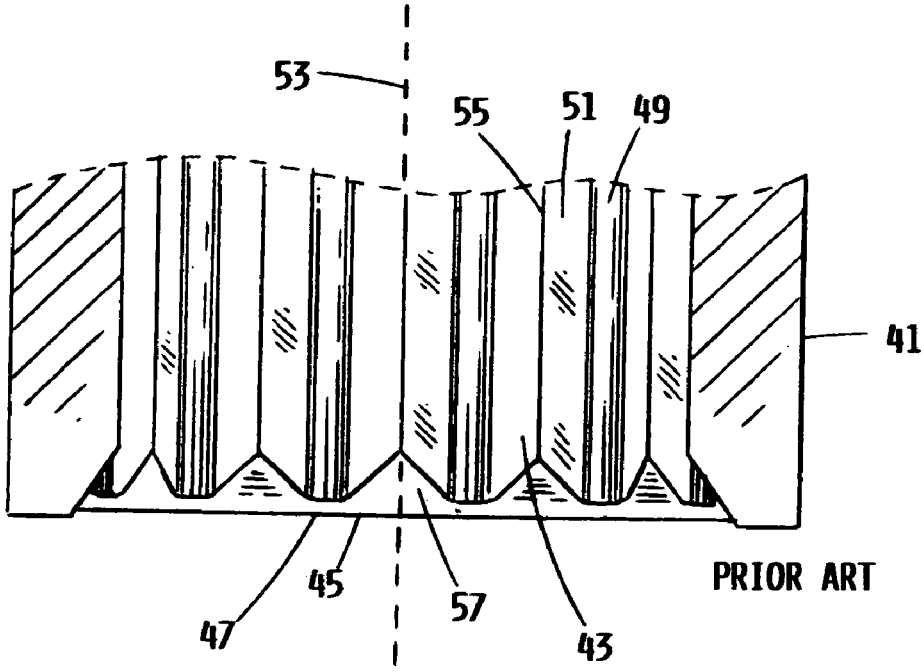

FIG. 3 shows a front elevation, cross-sectional cut view of another prior art tool device 41 which has an orifice 43 which has an engagement end 45 formed to control the rotation of a work piece (not shown). Tool device 41 has a peripheral terminal end 47 which is the terminal or distal end of the tool device at engagement end 45. Orifice 43 is defined by an inner wall of alternating recessed regions and engagement regions arranged about an imaginary central axis 53. Recessed region 49 is representative of the recessed regions while engagement region 51 is representative of the engagement regions. The recessed regions and engagement regions extend longitudinally and substantially parallel to imaginary central axis 53 as shown. Importantly, tool device 41 is beveled completely around and into orifice 43 with beveled surface 57 as shown, to facilitate initial alignment of orifice 43 with a work piece such as a nut, bolt, etc. Unfortunately, this beveled surface 57 reduces the length of the engagement regions such as engagement region 51, particularly at the engagement region parts such as that represented by engagement region part 55 of engagement region 51. It is easy to see in this view that no part of each engagement region extends farther towards the peripheral terminal end 47 of tool device 41 than any part of each recessed region such as recessed region 49. In fact, engagement part 55 is substantially shortened by beveled surface 57 such that engagement part 55 does not extend fully to the terminal end 47 of tool device 41 thereby reducing maximum longitudinal engagement and torque capacity. Worse yet, the loss of engagement would occur at the base of a work piece (not shown), believed to be the most critical area of engagement necessary to reduce wrench engagement failures and maximize torque capacity. Applicant believes that this prior art wrench configuration may actually promote wrench engagement failures and the aforementioned "tilt-off" and/or "taper-off" events.

Figure 4:
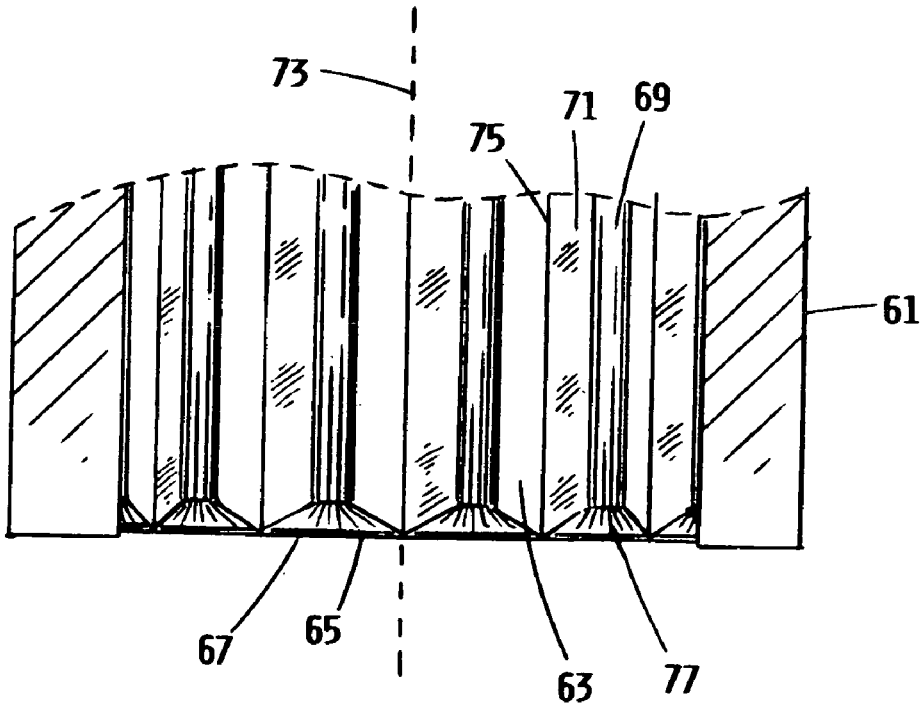

FIG. 4 shows a front elevation, cross-sectional cut view of another present invention tool device 61 which has an orifice 63 which has an engagement end 65 formed to control the rotation of a work piece (not shown). Tool device 61 has a peripheral terminal end 67 which is the terminal or distal end of the tool device at engagement end 65. Orifice 63 is defined by an inner wall of alternating recessed regions and engagement regions arranged about an imaginary central axis 73. Recessed region 69 is representative of the recessed regions while engagement region 71 is representative of the engagement regions. The recessed regions and engagement regions extend longitudinally and substantially parallel to imaginary central axis 73 as shown. Importantly, tool device 61 is not beveled completely around and into orifice 63, as is the case with the prior art tool device shown in FIG. 3. But rather, the present invention individually bevels or enlarges the recessed regions (or a part thereof such as recessed region 69 which is individually enlarged with enlarged area 77 at the engagement end 65 of tool device 61 to facilitate initial alignment of orifice 63 with a work piece such as a nut, bolt, etc. (not shown.) This alternating, individual enlarging/beveling arrangement at the engagement end of the tool device provides opportunity to maintain or maximize the longitudinal length of the engagement regions, or least a part thereof fully to the terminal end of tool device. The present invention may also include a beveling of the engaging regions at the peripheral terminal end of the tool device to facilitate initial alignment of the orifice to a work piece, provided that, at least a part of each engaging region extends farther towards the peripheral terminal end of the tool device than at least a part of each recessed region. In this FIG. 4 it can be seen that engagement region part 75 of engagement region 71 extends fully to the peripheral terminal end 67 of tool device 61, while each recessed region such as recessed region 69 does not. Such an arrangement maximizes longitudinal engagement between orifice and work piece thereby reducing engagement failures and the aforementioned "tilt-off" and/or "taper-off" events, while still providing for an ease of initial alignment between orifice and work piece.

Referring now to FIGS. 5 and 6 together, FIG. 5 shows a top plan view of another prior art tool device and work piece; and, FIG. 6 shows a front elevation, cross-sectional view of the tool device and work piece shown in FIG. 5. Tool device 91 has engagement end 95 and peripheral terminal end 97. Tool device 91 is engaged with work piece 93 and it can be seen in FIG. 6 that there is a substantial amount of vertical or longitudinal engagement contact lost between tool device 91 and work piece 93 resulting from the flawed design of this common, prior art wrench. In fact, applicant believes that some prior art designs may in some instances, actually fail to initially engage with as much as 35% of the vertical surfaces of a work piece such as a fastener, nut, bolt etc. To make matters worse, the loss of engagement occurs at the base (attachment end) of the work piece, believed by applicant to be the most critical area of engagement necessary to reduce wrench engagement failures and maximize torque capacity.

Referring now to FIGS. 7 and 8 together, FIG. 7 shows a top plan view of another present invention tool device and work piece; and, FIG. 8 shows a front elevation, cross-sectional view of the tool device and work piece shown in FIG. 7. Tool device 101 has engagement end 105 and peripheral terminal end 107. Tool device 101 is engaged with work piece 103 and it can be seen in FIG. 8 that there is virtually no loss of vertical or longitudinal engagement contact between tool device 101 and work piece 103 as a result of this present invention design. In fact, applicant believes that the present invention tool device may in some instances, actually increase vertical engagement contact between a tool device and work piece by as much as about 35%. Better yet, the increase of engagement occurs at the base (attachment end) of the work piece, believed by applicant to be the most critical area of engagement necessary to reduce wrench engagement failures and maximize torque capacity.

FIG. 9 shows a top plan view of another present invention tool device with six recessed regions, wherein a wrench socket 201 is structured for attachment with a ratcheting wrench lever (not shown). Wrench socket 201 has an orifice 202 which has at least one engagement end 203 formed to control the rotation of a work piece (not shown). Wrench socket 201 has a peripheral terminal end 205 at engagement end 203. Orifice 202 is defined by an inner wall of alternating recessed regions and engagement regions arranged about an imaginary central axis 211. Recessed regions such as recessed region 207 and engagement regions such as engagement region 209 extend longitudinally and substantially parallel to imaginary central axis 211. At least a part of each engagement region such as engagement region 209, extends farther towards the peripheral terminal end 205 of wrench socket 201 than at least a part of each recessed region such as recessed region 207. And, in the same or other embodiments of the present invention each recessed region may have at least a part thereof being individually enlarged such as enlargement area 213 at terminal end 205 of wrench socket 201 to facilitate initial alignment of orifice 202 with a work piece (not shown.) And, in the same or other embodiments of the present invention, each engagement region such as engagement region 209 may have at least a part thereof extending to the peripheral terminal end 205 of the tool device, so as to maximize longitudinal engagement of the orifice 202 with a work piece (not shown.)

FIG. 10 shows a top plan view of another present invention tool device with six recessed regions, wherein a wrench socket 221 is structured for attachment with a ratcheting wrench lever (not shown). Wrench socket 221 has an orifice 222 which has at least one engagement end 223 formed to control the rotation of a work piece (not shown). Wrench socket 221 has a peripheral terminal end 225 at engagement end 223. Orifice 222 is defined by an inner wall of alternating recessed regions and engagement regions arranged about an imaginary central axis 231. Recessed regions such as recessed region 227 and engagement regions such as engagement region 229 extend longitudinally and substantially parallel to imaginary central axis 231. At least a part of each engagement region such as engagement region 229, extends farther towards the peripheral terminal end 225 of wrench socket 221 than at least a part of each recessed region such as recessed region 227. And, in the same or other embodiments of the present invention each recessed region may have at least a part thereof being individually enlarged such as enlargement area 233 at terminal end 225 of wrench socket 221 to facilitate initial alignment of orifice 222 with a work piece (not shown). And, in the same or other embodiments of the present invention, each engagement region such as engagement region 229 may have at least a part thereof extending to the peripheral terminal end 225 of the tool device, so as to maximize longitudinal engagement of the orifice 222 with a work piece (not shown.)

FIG. 11 shows a top plan view of a present invention tool device box wrench with six recessed regions, wherein a box wrench 241 has an orifice 242 which has at least one engagement end 243 formed to control the rotation of a work piece (not shown). Box wrench 241 has a peripheral terminal end 245 at engagement end 243. Orifice 242 is defined by an inner wall of alternating recessed regions and engagement regions arranged about an imaginary central axis 251. Recessed regions such as recessed region 247 and engagement regions such as engagement region 249 extend longitudinally and substantially parallel to imaginary central axis 251. At least a part of each engagement region such as engagement region 249, extends farther towards the peripheral terminal end 245 of box wrench 241 than at least a part of each recessed region such as recessed region 247. And, in the same or other embodiments of the present invention, each recessed region may have at least a part thereof being individually enlarged such as enlargement area 253 at terminal end 245 of wrench socket 241 to facilitate initial alignment of orifice 242 with a work piece (not shown). And, in the same or other embodiments of the present invention, each engagement region such as engagement region 249 may have at least a part thereof extending to the peripheral terminal end 245 of the tool device, so as to maximize longitudinal engagement of the orifice 242 with a work piece (not shown.)

FIG. 12 shows a top plan view of another present invention tool device box wrench with a ratcheting mechanism and twelve recessed regions, wherein ratcheting wrench 261 has an orifice 262 which has at least one engagement end 263 formed to control the rotation of a work piece (not shown). Ratchet wrench 261 has a peripheral terminal end 265 at engagement end 263. Orifice 262 is defined by an inner wall of alternating recessed regions and engagement regions arranged about an imaginary central axis 271. Recessed regions such as recessed region 267 and engagement regions such as engagement region 269 extend longitudinally and substantially parallel to imaginary central axis 271. At least a part of each engagement region such as engagement region 269, extends farther towards the peripheral terminal end 265 of ratchet wrench 261 than at least a part of each recessed region such as recessed region 267. And, in the same or other embodiments of the present invention, each recessed region may have at least a part thereof being individually enlarged such as enlargement area 273 at terminal end 265 of wrench socket 261 to facilitate initial alignment of orifice 262 with a work piece (not shown). And, in the same or other embodiments of the present invention, each engagement region such as engagement region 269 may have at least a part thereof extending to the peripheral terminal end 265 of the tool device, so as to maximize longitudinal engagement of the orifice 262 with a work piece (not shown.)

It is believed that the present invention maximum engagement wrench will have many applications to many different tool devices, including but not limited to wrench sockets, box type wrenches, combination wrenches, flare nut wrenches, flex head wrenches, ratcheting type wrenches and the like. When considering the present invention, simplicity and obviousness should not be confused or considered the same. Accordingly, the novelty and complexity of the present invention must be measured by the combination of structure and function resulting from the many interrelated objectives set forth herein.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A tool device comprising an orifice having at least one engagement end formed to control the rotation of a work piece, said tool device having a peripheral terminal end at said engagement end, said orifice being defined by an inner wall of alternating recessed regions and engagement regions arranged about an imaginary central axis, said recessed regions and engagement regions extending longitudinally and substantially parallel to said imaginary central axis, at least a part of each said engagement region extending farther towards the peripheral terminal end of said tool device than at least a part of each said recessed region, and, each said recessed region having at least a part thereof being individually enlarged at the terminal end of said tool device to facilitate initial alignment of said orifice with said work piece.

2. A tool device of claim 1, wherein said orifice comprises a specific quantity of said recessed regions, and, the quantity of recessed regions is divisible by six using whole numbers.

3. A tool device of claim 2, wherein said tool device is a wrench socket.

4. A tool device of claim 2, wherein the orifice of said tool device is formed in a box type wrench head.

5. A tool device of claim 1, wherein said tool device is a wrench socket.

6. A tool device of claim 1, wherein the orifice of said tool device is formed in a box type wrench head.

7. A tool device comprising an orifice having at least one engagement end formed to control the rotation of a work piece, said tool device having a peripheral terminal and at said engagement end, said orifice being defined by an inner wall of alternating recessed regions and engagement regions arranged about an imaginary central axis, said recessed regions and engagement regions extending longitudinally and substantially parallel to said imaginary central axis, each said engagement region having at least a part thereof extending to the terminal end of said tool device so as to maximize longitudinal engagement of said orifice with said work piece, and, each said recessed region having at least a part thereof being individually enlarged at the terminal end of said tool device to facilitate initial alignment of said orifice with said work piece.

8. A tool device of claim 7, wherein said orifice comprises a specific quantity of said recessed regions, and the quantity of recessed regions is divisible by six using whole numbers.

9. A tool device of claim 8, wherein said tool device is a wrench socket.

10. A tool device of claim 8, wherein the orifice of said tool device is formed in a box type wrench head.

11. A tool device of claim 7, wherein said tool device is a wrench socket.

12. A tool device of claim 7, wherein the orifice of said tool device is formed in a box type wrench head.

* * * * *

UNITED STATES PATENT AND TRADEMARK OFFICE

CERTIFICATE OF CORRECTION

PATENT NO. : 7,228,764 B1
APPLICATION NO. : 11/322310
DATED : June 12, 2007
INVENTOR(S) : Richard J. Macor It is certified that error appears in the above-identified patent and that said Letters Patent is hereby corrected as shown below:

At Column 8 in Claim 7, in the third line please delete the word "and" then replace it with the correct word --end--.

Signed and Sealed this

Eighth Day of January, 2008

JON W. DUDAS
*Director of the United States Patent and Trademark Office*